US006253995B1

(12) United States Patent
Blok et al.

(10) Patent No.: US 6,253,995 B1
(45) Date of Patent: Jul. 3, 2001

(54) INSULATED CONTAINERS AND SIDEWALLS HAVING LATERALLY EXTENDING FLUTES, AND METHODS

(75) Inventors: Johannes Blok, Cincinnati; William H. Carr, Jr., West Chester, both of OH (US)

(73) Assignee: Burrows Paper Corporation, Little Falls, NY (US)

( * ) Notice: Subject to any disclaimer, the term of this patent is extended or adjusted under 35 U.S.C. 154(b) by 0 days.

(21) Appl. No.: 09/570,512

(22) Filed: May 16, 2000

(51) Int. Cl.[7] ..... B65D 3/28

(52) U.S. Cl. ..... 229/403; 229/4.5; 229/198.2; 229/939; 229/940; 493/152; 493/903; 493/906

(58) Field of Search ..... 229/4.5, 198.2, 229/400, 403, 939, 940; 493/121, 128, 129, 133, 134, 135, 152, 903, 906, 907, 908

(56) References Cited

U.S. PATENT DOCUMENTS

| | | | | |
|---|---|---|---|---|
| Re. 25,618 | | 7/1964 | Goodman . | |
| 1,299,924 | * | 4/1919 | Cullen | 229/198.2 |
| 1,845,891 | * | 2/1932 | Schroeder | 229/198.2 |
| 2,127,029 | | 8/1938 | Hermanson . | |
| 2,181,035 | | 11/1939 | White . | |
| 2,266,828 | | 12/1941 | Sykes . | |
| 2,661,889 | | 12/1953 | Phinney . | |
| 2,695,744 | | 11/1954 | Gattuso . | |
| 2,853,222 | | 9/1958 | Gallagher . | |
| 2,969,901 | | 1/1961 | Behrens . | |
| 3,145,131 | * | 8/1964 | Finke | 229/939 |
| 3,456,860 | | 7/1969 | Janninck . | |
| 3,456,863 | * | 7/1969 | Mollison et al. | 229/939 |
| 3,668,049 | | 6/1972 | Silfverlin . | |
| 3,908,523 | | 9/1975 | Shikaya . | |
| 4,080,880 | | 3/1978 | Shikaya . | |
| 4,176,054 | | 11/1979 | Kelley . | |
| 4,993,580 | | 2/1991 | Smith . | |
| 5,092,485 | | 3/1992 | Lee . | |
| 5,205,473 | | 4/1993 | Coffin, Sr. . | |
| 5,226,585 | | 7/1993 | Varano . | |
| 5,326,019 | | 7/1994 | Wolff . | |
| 5,363,982 | | 11/1994 | Sadlier . | |
| 5,385,260 | | 1/1995 | Gatcomb . | |
| 5,460,323 | | 10/1995 | Titus . | |
| 5,685,480 | * | 11/1997 | Choi | 229/403 |
| 5,697,550 | * | 12/1997 | Varano et al. | 229/4.5 |
| 5,839,653 | | 11/1998 | Zadravetz . | |

OTHER PUBLICATIONS

"Handbook For Pulp & Paper Technologists", by G.A. Smook © 1982 pp. 208, 291, 296, & 297.

* cited by examiner

*Primary Examiner*—Gary E. Elkins
(74) *Attorney, Agent, or Firm*—Dinsmore & Shohl LLP

(57) ABSTRACT

An insulated container comprises a sidewall formed with an outer layer, an inner layer, and a fluted layer located between the outer and inner layers. The fluted layer includes elongated flutes extending in a substantially lateral direction around the container. The inner layer comprises a paper layer arranged with its machine direction extending substantially perpendicular to the direction in which the flutes extend. The outer layer comprises paper that is capable of stretching sufficiently to accommodate an outer circumference of the container. Additional insulated containers and sidewalls having laterally extending flutes and methods therefor are further provided.

29 Claims, 4 Drawing Sheets

INSULATED CONTAINERS AND SIDEWALLS HAVING LATERALLY EXTENDING FLUTES, AND METHODS

TECHNICAL FIELD

This invention relates generally to insulated containers, and more particularly to insulated containers having an intermediate fluted layer, sidewalls for forming such containers, and methods therefor.

BACKGROUND OF THE INVENTION

Insulated disposable cups for holding hot and cold beverages and other items have long been fabricated from inexpensive, light-weight materials such as expanded polystyrene. However, polystyrene is not biodegradable and therefore causes an environmental concern. Paper cups are also common, and are considered more environmentally sensitive, but are often undesirable since they readily transfer heat. A consumer may handle an uninsulated paper container with a napkin, another cup or other insulating sleeve. However, requiring a separate sleeve, cup or holder is expensive, cumbersome and may result in losing control of the container and unfortunate spillage of its contents.

FIG. 1 depicts a conventional insulated paper container 100 of the type substantially as described in U.S. Pat. No. 5,839,653. The container 100 has an upstanding wall 112 defining a volume 114 and is composed of a corrugated paperboard material having an inner paper layer 122, an insulating fluted layer 126 having vertically extending flutes 128, and an outer paper layer 124. However, when the upper edge of the upstanding wall 112 is rolled to form a lip 118, undesirable tearing or cracking 119 can result owing to the fiber orientation of the inner layer. Accordingly, this type of container does not consistently provide a desirable substitute for polystyrene containers and a need continues for environmentally friendly insulating containers.

SUMMARY OF THE INVENTION

Accordingly, it is an object of the present invention to obviate problems and shortcomings of conventional containers. More particularly, it is an object of the present invention to provide an insulated container having improved structural characteristics.

Another object of the invention is to provide an environmentally friendly disposable insulated container.

Another object of the invention is to provide an insulated container of unitary construction.

Yet another object of the invention is to provide an insulated container which may be formed with a smooth rim.

A further object of the invention is to provide an insulated container having an outer layer capable of receiving and displaying high quality print.

Another object of the invention is to simplify the fabrication of such insulated containers.

To achieve the foregoing and other objects and in accordance with the present invention insulating containers are provided with a sidewall formed with an outer layer, an inner layer, and a fluted layer located between the outer and inner layers. The fluted layer includes elongated flutes extending in a substantially lateral direction around the container. The inner layer comprises a paper layer arranged with its machine direction extending substantially perpendicular to the direction in which the flutes extend. The outer layer comprises paper that is capable of stretching sufficiently to accommodate an outer circumference of the container.

To further achieve the foregoing and other objects and in accordance with the present invention insulating containers are provided including a sidewall defining an interior area. The sidewall comprises a paper inner layer, a paper outer layer, and a paper fluted layer located between the inner layer and the outer layer. The fluted layer includes elongated flutes extending in a substantially lateral direction around the container with the inner layer arranged with its machine direction extending substantially perpendicular to the direction in which the flutes extend. The outer layer may comprise extensible kraft paper.

To further achieve the foregoing and other objects and in accordance with the present invention sidewalls are provided including a first seam portion and a second seam portion. The sidewall comprises an inner layer including a surface provided with a water resistant coating, an outer layer, and a fluted layer located between the inner layer and the outer layer. A portion of the inner layer extends beyond both a portion of the fluted layer and a portion of the outer layer at the first seam portion.

To further achieve the foregoing and other objects and in accordance with the present invention methods of making insulated containers are provided. A sidewall is provided including an upper edge, a first seam portion, and a second seam portion. The sidewall includes an inner paper layer, an outer paper layer of stretchable paper, and a fluted layer located between the inner layer and the outer layer, wherein the fluted layer includes elongated flutes. The sidewall is curved along a circumferential direction, with the flutes extending substantially along the circumferential direction and a machine direction of the inner layer extending substantially perpendicular to the direction in which the flutes extend, until the first seam portion is adjacent the second seam portion. The second seam portion is attached to the first seam portion to form a shape including an interior area.

To further achieve the foregoing and other objects and in accordance with the present invention methods of making water resistant seams are provided. A sidewall is provided including a first seam portion and a second seam portion. The sidewall includes an inner layer provided with a coating of water resistant material, an outer layer, and a fluted layer located between the inner layer and the outer layer. A portion of the inner layer extends beyond a portion of the fluted layer and a portion of the outer layer at the first seam portion. The inner surface of the inner layer of the second seam portion is attached to the outer surface of the inner layer of the first seam portion, thereby forming the water resistant seam.

Still other objects and advantages of the present invention will become apparent to those skilled in the art from the following description wherein there are shown and described alternative exemplary embodiments of this invention. As will be realized, the invention is capable of other different, obvious aspects and embodiments, all without departing from the invention. Accordingly, the drawings and descriptions should be regarded as illustrative in nature and not as restrictive.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION

Figure 1:
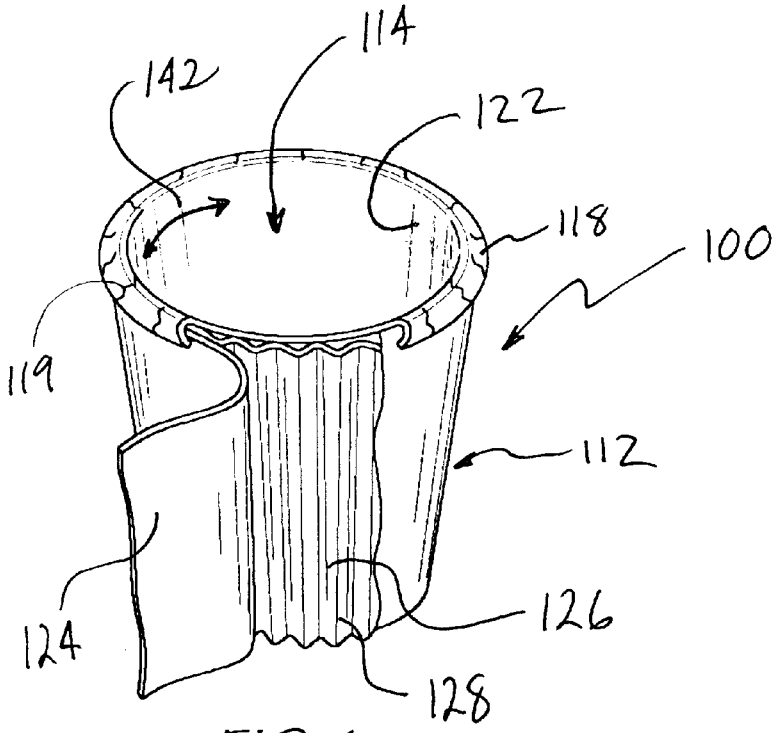
FIG. 1 PRIOR ART
FIG. 1 is a perspective view of a conventional container in partial cut away and showing an outer paper layer peeled away to reveal a fluted layer having vertically oriented flutes.
Figure 2:
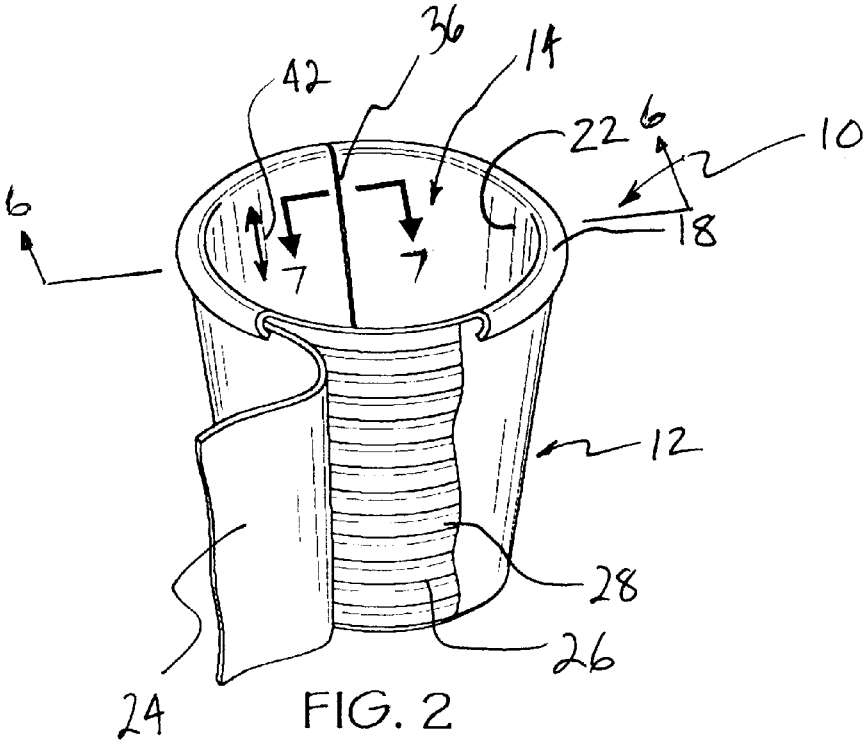
FIG. 2 is a perspective view of a container in accordance with the present invention in partial cut away and showing an outer paper layer peeled away to reveal a fluted layer having flutes extending in a substantially lateral direction around the container.
Figure 3:
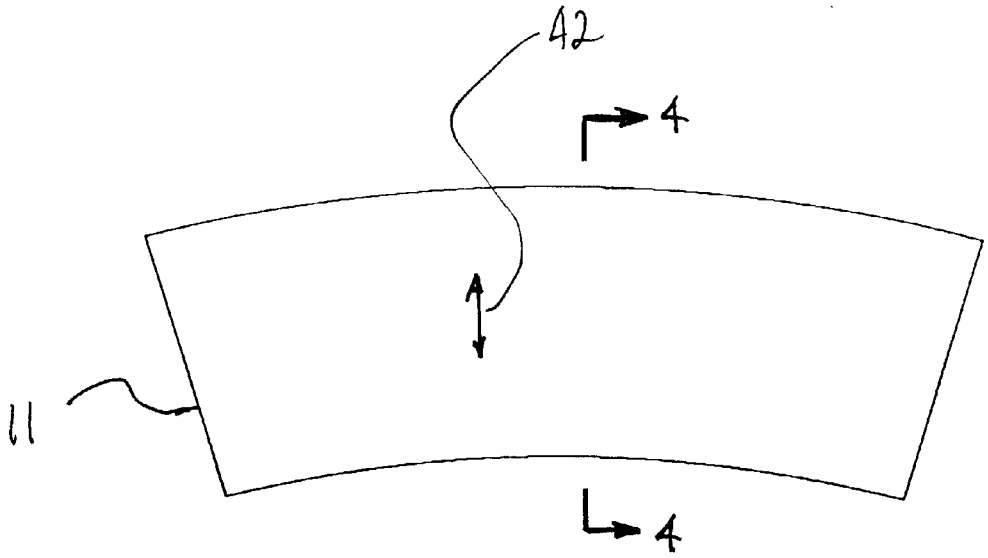
FIG. 3 is a plan view of a sidewall prior to formation of a cup.
Figure 4:
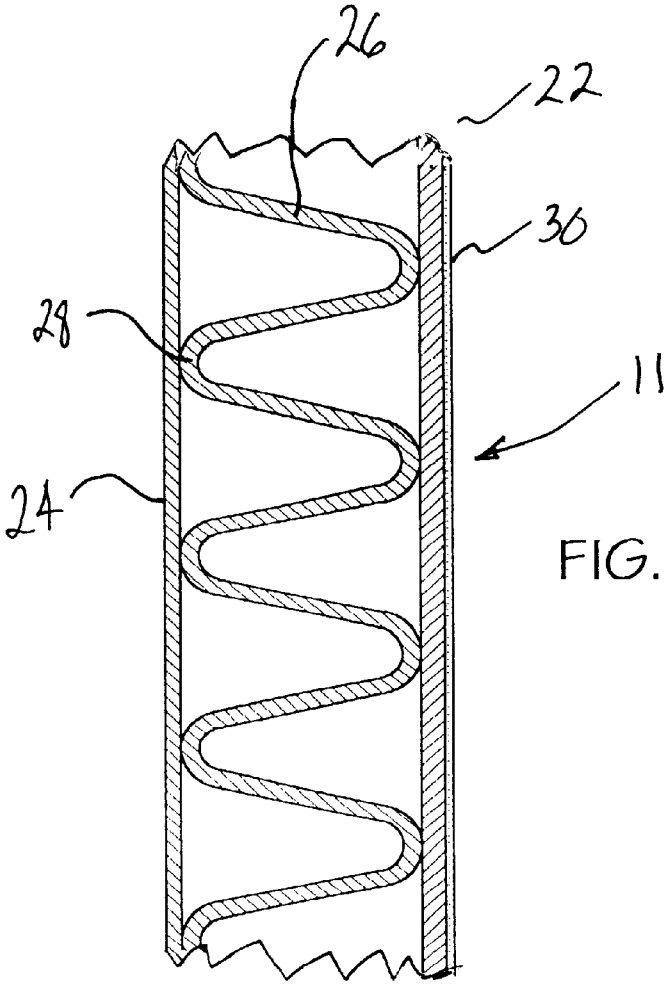
FIG. 4 is a fragmentary cross section of the sidewall taken along line 4—4 of FIG. 3.

As best shown in FIG. 2, a disposable and insulated container 10 such as a cup, cone, bucket, sleeve, or the like is disclosed. The container 10 may be used in a variety of environments to support and/or store various objects in an insulating manner. The container 10 is particularly useful for storing or supporting hot and/or cold items since the container is formed with insulating properties. The insulated container protects a user handling the container 10 while interrupting heat transfer between the container and the environment to help maintain the item at its desired temperature.

For instance, the container may be formed as a cup for supporting hot or cold beverages. Since the container 10 itself has insulating properties, an additional sleeve, napkin, or the like is not necessary to handle the container. Additionally, the cup slows the warming of cold beverages or cooling of hot beverages.

The container 10 may also be formed as a cone for holding hot or cold items. For example, a cone may be provided to hold cold or hot beverages, ice cream, shaved ice, or the like.

Alternatively, the container 10 may be formed in the shape of a large, medium or small bucket, for example, for storing food items. The bucket may be formed with shapes having a rectangular, triangular, or other geometric cross-sectional shapes, all with sharp or rounded corners. The bucket may also be formed in other shapes (e.g., a container having an oval cross section (not shown) or circular cross section as best shown in FIG. 2).

Figure 6:
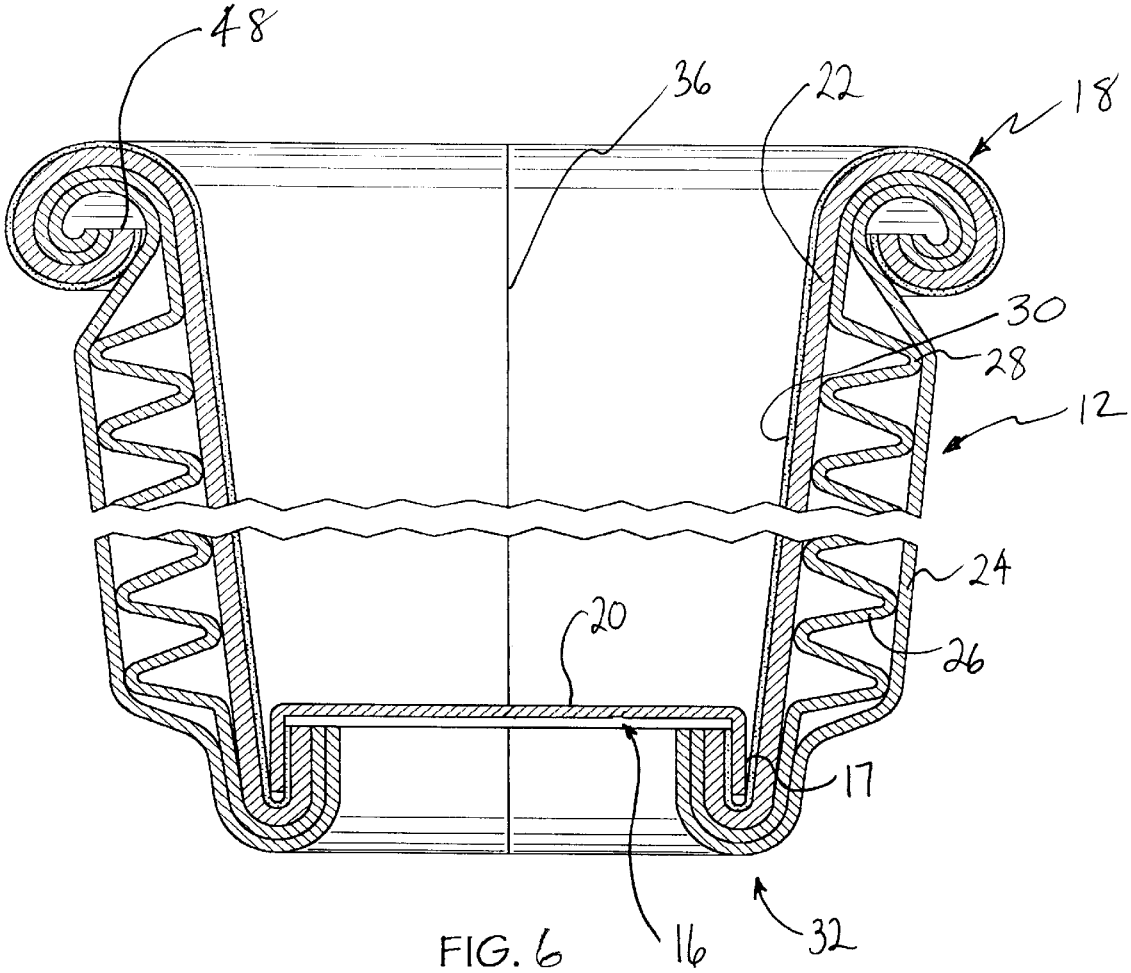
FIG. 6 is a fragmentary cross section taken along line 6—6 of FIG. 2.

Each of the container shapes may have substantially vertical side wall(s) such that a cross sectional area at the bottom portion of the container is substantially equal to the cross sectional area at the top portion of the container. Alternatively, the wall(s) may be angled relative to a vertical direction. For instance, the walls may be angled such that the cross section of the container at the base is different than the cross sectional area at the top portion of the container. For example, a wall of a container having a circular cross section may have a smaller cross sectional area at the base than at the top portion of the bucket as best shown in FIGS. 2 and 6. Such a container would form a wall having a truncated frustroconical shape.

It will be appreciated that the insulating properties of the container help maintain the stored items at a constant temperature. For instance, the container may be used to store a pint or gallon of ice cream, thereby preventing the ice cream from melting during transport between wholesale and retail outlets or after purchase. The container may also be used to maintain other food items at a relatively high temperature. For example, the container may be formed to hold fast food items, such as french fries, fried chicken, hot peanuts, popcorn, or the like.

Each of the containers described above is formed from a sidewall 12 defining an interior area 14 for storing and/or supporting items. The sidewall 12 may be shaped into a container without a bottom wall, thereby forming a cone, sleeve, or the like. Alternatively, the sidewall 12 may be attached to a bottom wall 16, as shown in FIG. 6, to form a cup, bucket, or the like.

As shown in FIG. 2, the sidewall includes an inner layer 22, an outer layer 24, and a fluted layer 26 located between the inner layer 22 and the outer layer 24. The inner layer 22 and outer layer 24 are bonded to the fluted layer 26, for example with an adhesive. The adhesive may be formed of any adhesive known in the art, and may be, for example, biodegradable, nonbiodegradable, recyclable, or nonrecyclable adhesive. For example, the adhesive may comprise starch, polyethylene or the like.

The fluted layer 26 is defined as any layer having flutes extending along its length and, alternatively or additionally, is defined as any corrugating medium. The fluted layer 26 includes elongated channels or flutes 28. The flutes 28 extend in a substantially lateral direction around the container. A substantially lateral direction is defined as any direction extending laterally around the container or a direction at a slight angle relative to the lateral direction around the container. A substantially lateral direction is further defined to include flutes that extend at an angle relative to the lateral direction due to angled wall(s) of the container (e.g., a truncated frustoconical wall). Extending the flutes in a substantially lateral direction orients the machine direction of the inner paper layer in a direction substantially perpendicular to the flutes and therefore in a substantially vertical direction and allows an upper portion of the sidewall 12 to be rolled or curled to form a lip or rounded rim 18 without splitting or tearing the rim, as described more fully below. Moreover, orienting the flutes in a substantially lateral direction assists in rolling the wall to form the rim 18 which thereby extends substantially parallel to the flutes. In containers having a bottom wall, as shown in FIG. 6 for example, the substantially laterally extending flutes 28 also allow a lower portion 32 of the sidewall 12 to be easily bent about the circumferential lip 17 extending downwardly from the upper surface 20 of the bottom wall 16.

The fluted layer 26 is formed from paper, plastic, or the like. Typically, the fluted layer will be a paper layer. The fluted layer 26, for instance, may be formed from fluted paper having a weight of from about 20 to about 90 lb/3000 $ft^2$. In a more specific embodiment, the fluted paper has a weight of from about 30 to about 60 lb/3000 $ft^2$, and in one embodiment, the fluted paper has a weight of about 30 lb/3000 $ft^2$. The vertical distance between the tips of the flutes, i.e., the height of the flutes, is dependent on the flute profile and may be, for example, from about 0.015 to about 0.05 inches, and in one embodiment, is about 0.03 inches (i.e., typically referred to as F-Flute). It is understood that the height of the flutes may be selected in accordance with the amount of insulation required by the particular application of the container. A higher flute caliper (i.e., height) will result in a container having higher insulating properties. The pitch of the flutes may range from about 80 to about 200 flutes per foot, more specifically from about 100 to about 150 flutes per foot. The fluted layer, for example, may be formed from corrugating miniflute profiles known in the art such as E-Flute, F-Flute, G-Flute, or N-Flute. In one embodiment, the fluted layer 26 is formed with an F-Flute material.

The outer layer 24 is formed from stretchable paper that allows the paper to stretch as it is formed in the shape of the particular container. For instance, the stretchable paper may comprise extensible paper in the form of creped paper, embossed paper, extensible kraft paper, or the like, each being bleached or unbleached. Typically, creped paper and embossed paper are not ideal for fine or high quality printing applications since they may not provide a sufficiently smooth outer surface for printing such images.

In applications where high quality printing is desired, the outer layer 24 may be formed from bleached or unbleached extensible kraft paper that allows higher quality printing of indicia and pictures for advertising, identification, product information or the like. Extensible kraft paper provides a stretching at the fiber level of the paper. One process capable of producing extensible kraft paper is described in the "Handbook For Pulp & Paper Technologists" by G. A. Smook, 1982, page 291, herein incorporated by reference. On page 291 of Smook, a clupak compactor device is described as being used to force shrink the paper (e.g. kraft paper), thereby creating an extensible paper (e.g. extensible kraft paper). The extensible kraft paper typically has a weight in the range of from about 20 to about 90 lb/3000 $ft^2$, more specifically from about 25 to about 35 lb/3000 $ft^2$, and in one embodiment, about 30 lb/3000 $ft^2$. Extensible kraft paper suitable for this design may be obtained from various paper suppliers such as International Paper.

The inner layer 22 may be formed from paper, plastic, or the like. Typically, the inner layer is paper and may comprise light weight cup stock to provide the container with sufficient structural integrity. The inner layer 22 is not necessarily formed of extensible material. Unlike the fluted layer 26 and the outer layer 24, which extend as the inner layer 22 bends to define the interior area 14 of the container 10, such extension is not required for the inner layer. The inner layer 22 may be formed from light weight cup stock, plate stock, or liner board. The inner layer material may be light weight since the combination of the inner layer 22, the outer layer 24 and the fluted layer 26 form a sturdy sidewall with high structural integrity. For instance, the inner layer 22 may be formed from 3–24 point cup stock paper having a weight of from about 30 to about 160 lb/3000 $ft^2$. In one embodiment, the inner layer 22 is formed from 6–14 point paper having a weight of from about 50 to about 120 lb/3000 $ft^2$.

Figure 5:
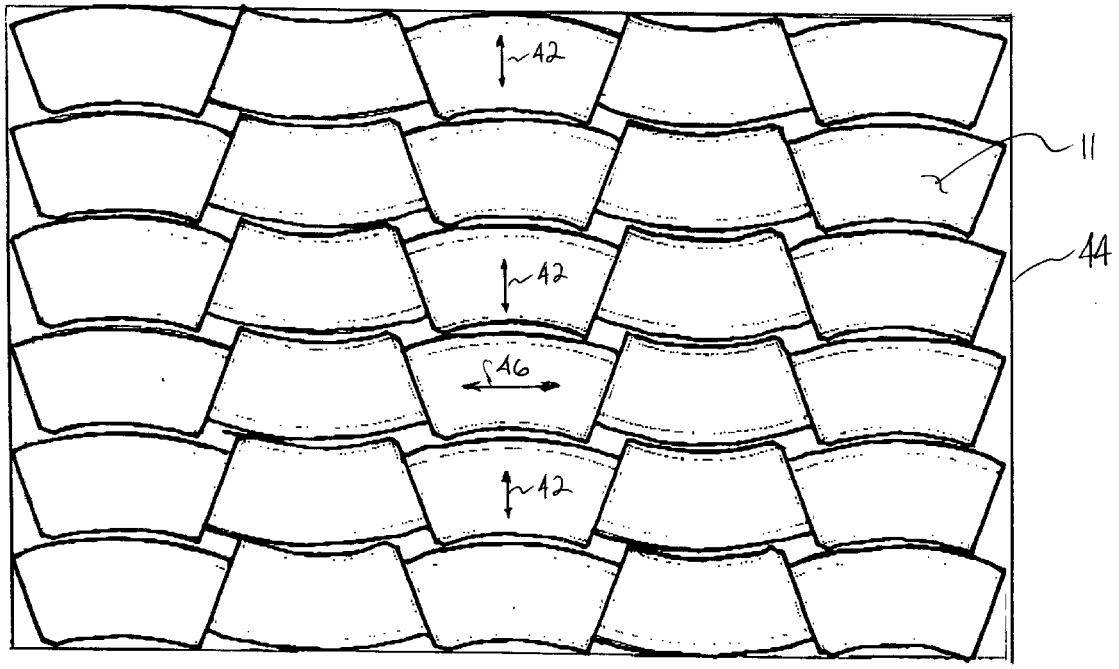
FIG. 5 is a plan view of a sheet of material illustrating the orientation of the sidewall in relation to the paper machine direction.

FIG. 5 illustrates an exemplary orientation for cutting blanks 11 from sheet material 44 prior to formation of the sidewalls for containers according to the invention. Sheet material as shown in FIG. 5 typically comprises an assembly of the three layers of material used to form the inner, fluted and outer layers of the sidewall. The sheet material is fabricated in an elongated direction, known in the art as the machine direction 42, and then typically cut in sheets and stacked. As known in the art, the flutes extend along a fluted direction 46 substantially perpendicular to the machine direction 42. U.S. Pat. No. 5,839,653 suggests cutting the blanks such that the flutes extend substantially vertically in a formed cup. However, orienting the flutes in the manner suggested in U.S. Pat. No. 5,839,653 such that the machine direction of the inner layer extends substantially laterally may cause cracking and tearing of the inner paper layer as the material is rolled to form the lip. Accordingly, it is desirable in accordance with the invention to cut the sidewall blanks 11 from the sheet material 44 such that the machine direction 42 extends substantially vertically from the top of the sidewall blank to the bottom of the sidewall blank with the flute direction 46 extending substantially laterally along the sidewall. Cutting the sidewall blanks 11 in this manner reduces or eliminates the tendency of the inner layer 22 to crack and/or tear as it is rolled to form the lip 18. As shown in FIG. 5, the blanks 11 may be cut from a sheet in a plurality of rows and columns to save material. For example, the blanks 11 may be cut from a sheet 44 having dimensions of about 50 inches wide along the flute direction 46 and about 32 inches long along the machine direction 42. While FIG. 5 depicts the blanks 11 formed in five columns and six rows, it is understood that the blanks could be cut in any number of columns or rows. Moreover, the blanks 11 may be cut closer together in order to save additional material.

In one embodiment, at least the inner layer 22 comprises an inner surface provided with a coating 30 of water resistant material such as wax, polymer, or the like. The coating 30 may protect the sidewall from liquid and may form a seal between the sidewall 12 and the bottom wall 16 as described below. The coating 30 may be integrally formed with the inner layer 22. The coating 30 may also be sprayed, extruded, or otherwise applied to the inner layer 22. For instance, the coating 30 may be extruded as a film and applied to the inner layer 22. If the coating 30 is formed from a polymer, the polymer coating can be used in hot, as well as cold, environments. In one embodiment, the coating 30 comprises low density polyethylene that helps prevent the contents from leaking while protecting the integrity of the sidewall 12.

The outer layer 24 may also be provided with a coating of water resistant material to prevent condensation from damaging the sidewall. The outer layer 24 may also be grease resistant, thereby providing a grease-resistant barrier, in order to protect the sidewall from oil or other contaminants that the sidewall 12 typically encounters during the manufacturing process. The outer layer 24 may be inherently grease resistant, or alternatively, may be provided with a coating of grease-resistant material (not shown). The coating, if provided, may be integrally formed with the outer layer 24 of may be sprayed, extruded, or otherwise applied to the outer layer 24. The coating, for instance, may be formed from polyethylene, fluor-chemicals, or the like. For example, fluor-chemicals produced by 3M (e.g., FC-845 or FC-807) may be used to provide a grease-resistant coating.

As shown in FIG. 6, the lower portion 32 of the sidewall 12 may be compressed and bent around the circumferential flange 17 of the bottom wall 16. Heating the lower portion melts the polyethylene coating 30 to both sides of the circumferential flange 17, thereby forming a water tight seal.

Figure 7:
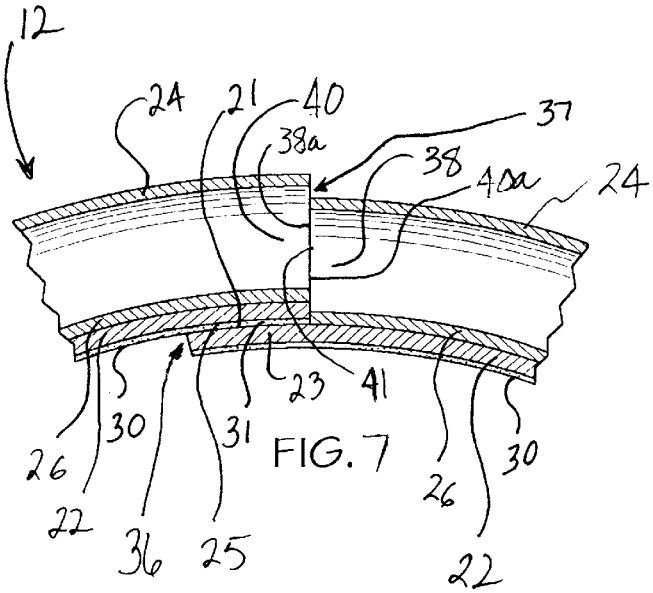
FIG. 7 is a fragmentary cross section taken along line 7—7 of FIG. 2.

As shown in FIGS. 2, 6 and 7, seam portions of the sidewall 12 are connected together to form a seam 36. As best illustrated in FIG. 7, a portion 31 of the coating 30 of water resistant material adjacent a second seam portion 40 is used to attach the second seam portion 40 to the first seam portion 38, thereby forming the substantially water resistant seam 36. The relative thicknesses of the layers of the sidewall 12, shown throughout the figures, are illustrative in nature and are not necessarily drawn to scale. For instance, in FIG. 7, the shoulder 37 resulting from overlap as described below will actually be negligible or nonexistent according to the relative thicknesses of the layers and melting and/or compression of certain material(s) during the formation of the seam 36.

Also as shown in FIG. 7, a portion of the inner layer 22 extends beyond a portion of the fluted layer 26 and a portion of the outer layer 24 at the first seam portion 38. In one embodiment, a portion of the fluted layer 26 and a portion of the outer layer 24 of the first seam portion 38 are removed such that the inner layer 22 of the first seam portion 38 overlaps the second seam portion 40. The overlapping layer 22 of seam portion 38 is attached to the adjacent inner layer 22 of seam portion 40 to form the seam 36. For example, the inner surface 25 of the inner layer 22 of seam portion 40 is connected with the outer surface of the adjacent inner layer 22 of the seam portion 38. By connecting the two together, for example with adhesive or by melting a water resistant coating on the inner layer inner surface, seam 36 is made water resistant. The fluted layer and the outer layer at the edge 38*a* of the seam portion 38 may optionally be arranged to substantially abut the fluted layer, the inner layer and/or the outer layer at the second seam edge 40*a* of the seam portion 40. Abutment of the seam edges 38*a* and 40*a* as shown at 41 in FIG. 7, may increase the structural integrity of the container.

The foregoing description of the various embodiments of the invention has been presented for the purposes of illustration and description. It is not intended to be exhaustive or to limit the invention to the precise form disclosed. Many alternatives, modifications and variations will be apparent to those skilled in the art. For instance, the thicknesses of materials and layers as shown in the drawings are for illustrative purposes only. It is understood, for example, that the thickness of the wall, as shown in FIG. 6, may be substantially smaller relative to the lip 18. Moreover, the end portion 48 of the sidewall 12 may not have each of the layers arranged with coplanar edges. Indeed, the edges of the layers may be offset. In addition, the lip may be rolled in other fashions. For example, the lip may be rolled with a larger or smaller diameter. Accordingly, this invention is intended to embrace all alternatives, modifications and variations that have been discussed herein, and others that fall within the spirit and broad scope of the claims.

What is claimed is:

1. An insulating container comprising a sidewall defining an interior area, the sidewall comprising an inner layer, an outer layer, and a fluted layer located between the inner layer and the outer layer, wherein the fluted layer includes elongated flutes extending in a substantially lateral direction around the container, wherein the inner layer comprises a paper layer arranged with its machine direction extending substantially perpendicular to the direction in which the flutes extend, and wherein the outer layer comprises paper that is capable of stretching sufficiently to accommodate an outer circumference of the container.

2. The insulating container of claim 1, wherein the outer layer comprises extensible kraft paper.

3. The insulating container of claim 1, wherein the fluted layer is bonded to the inner and outer layers with adhesive.

4. The insulating container of claim 3, wherein the adhesive comprises polyethylene.

5. The insulating container of claim 1, wherein at least the inner layer is substantially water resistant.

6. The insulating container of claim 5, wherein the inner layer is provided with a polymer coating which renders an inner surface of the inner layer substantially water resistant.

7. The insulating container of claim 6, wherein the polymer coating comprises polyethylene.

8. The insulating container of claim 1, wherein an upper portion of the sidewall comprises a rolled portion forming a rim.

9. The insulating container of claim 1, wherein the sidewall is curved.

10. The insulating container of claim 9, wherein the sidewall is formed in a substantially cylindrical or frustoconical shape.

11. The insulating container of claim 1, wherein an inner surface of the inner layer is provided with a water resistant coating.

12. The insulating container of claim 11, wherein the sidewall includes a seam and further wherein a portion of the water resistant coating adjacent a second seam portion adhesively attaches the second seam portion to a first seam portion thereby forming a substantially water resistant seam.

13. The insulating container of claim 12, wherein the portion of the water resistant coating attaching the seam portions attaches the inner surface of the inner layer of the second seam portion to an outer overlapping surface of the inner layer of the first seam portion.

14. The insulating container of claim 13, wherein a first seam edge of the first seam portion substantially abuts a second seam edge of the second seam portion.

15. The insulating container of claim 1, further comprising a bottom wall, wherein the sidewall is attached to the bottom wall at a lower portion of the sidewall.

16. The insulating container of claim 1, wherein the outer layer is at least substantially grease resistant.

17. The insulating container of claim 1, wherein the sidewall includes a first seam portion and a second seam portion, the inner layer includes a surface provided with a water resistant coating, and a portion of the inner layer extends beyond both a portion of the fluted layer and a portion of the outer layer at the first seam portion.

18. An insulating container comprising a sidewall defining an interior area, the sidewall comprising a paper inner layer, a paper outer layer, and a paper fluted layer located between the inner layer and the outer layer, wherein the fluted layer includes elongated flutes extending in a substantially lateral direction around the container, the inner layer is arranged with its machine direction extending substantially perpendicular to the direction in which the flutes extend, and the outer layer comprises extensible kraft paper.

19. A method of making an insulated container comprising:

a) providing a sidewall including an upper edge, a first seam portion, and a second seam portion, the sidewall further including an inner paper layer, an outer layer of stretchable paper, and a fluted layer located between the inner layer and the outer layer, wherein the fluted layer includes elongated flutes;

b) curving the sidewall along a circumferential direction, with the flutes extending substantially along the circumferential direction and a machine direction of the inner layer extending substantially perpendicular to the direction in which the flutes extend, until the first seam portion is adjacent the second seam portion; and c) attaching the second seam portion to the first seam portion to form a shape including an interior area.

20. The method of claim 19, wherein the inner layer is substantially water resistant.

21. The method of claim 20, wherein the inner layer is provided with a polymer coating providing the inner layer with substantial water resistance.

22. The method of claim 21, wherein the polymer coating comprises polyethylene.

23. The method of claim 20, wherein the inner layer is provided with a coating of water resistant material.

24. The method of claim 23, wherein a portion of the coating of water resistant material adjacent the second seam portion is used to attach the second seam portion to the first seam portion.

25. The method of claim 24, wherein a portion of the fluted layer and a portion of the outer layer of the first seam portion are removed such that the inner layer of the first seam portion overlaps the second seam portion and wherein the step of attaching the second seam portion to the first seam portion further comprises attaching the inner surface of the inner layer of the second seam portion, to the outer surface of the inner layer of the first seam portion.

26. The method of claim 19, comprising the further step of rolling an upper portion of the sidewall to form a rim.

27. The method of claim 19, wherein the outer layer is at least substantially grease resistant.

28. The method of claim 19, comprising the further steps of providing a bottom wall and attaching the bottom wall to the lower edge of the sidewall.

29. The method of claim 19 wherein the inner layer is provided with a coating of water resistant material, and a portion of the inner layer extends beyond a portion of the fluted layer and a portion of the outer layer at the first seam portion, and wherein the second seam portion is attached to the first seam portion by attaching the inner surface of the inner layer of the second seam portion, to the outer surface of the inner layer of the first seam portion, thereby forming a water resistant seam.

* * * * *